US005747921A

United States Patent [19]

Kim

[11] Patent Number: 5,747,921

[45] Date of Patent: May 5, 1998

[54] IMPREGNATION TYPE CATHODE FOR A CATHODIC RAY TUBE

[75] Inventor: Yeoung Ku Kim, Jeonranam-do, Rep. of Korea

[73] Assignee: Goldstar Co., Ltd., Seoul, Rep. of Korea

[21] Appl. No.: 819,020

[22] Filed: Mar. 17, 1997

Related U.S. Application Data

[63] Continuation of Ser. No. 318,376, Oct. 5, 1994, abandoned.

[30] Foreign Application Priority Data

Oct. 5, 1993 [KR] Rep. of Korea ..... 20489/1993

[51] Int. Cl.[6] ..... H01J 19/06; H01J 1/14

[52] U.S. Cl. ..... 313/346 R; 313/346 DC

[58] Field of Search ..... 313/346 R, 346 DC

[56] References Cited

U.S. PATENT DOCUMENTS

| | | | |
|---|---|---|---|
| 3,454,816 | 7/1969 | Hoffmann et al. | 313/346 DC |
| 4,274,030 | 6/1981 | Buxbaum | 313/346 R |
| 4,570,099 | 2/1986 | Green | 313/346 R |
| 4,594,220 | 6/1986 | Hasker et al. | 313/346 R |
| 4,737,679 | 4/1988 | Yamamoto et al. | 313/346 R |
| 4,783,613 | 11/1988 | Yamamoto et al. | 313/346 R |
| 4,855,637 | 8/1989 | Watanabe et al. | 313/346 R |
| 4,982,133 | 1/1991 | Choi | 313/346 DC |
| 5,126,622 | 6/1992 | Jeong et al. | 313/346 DC |
| 5,126,623 | 6/1992 | Choi | 313/346 DC |

FOREIGN PATENT DOCUMENTS

| | | | |
|---|---|---|---|
| 61-13526 | 1/1986 | Japan | 313/346 R |
| 63-78427 | 4/1988 | Japan | 313/346 R |
| 3165419 | 7/1991 | Japan | 313/346 R |

*Primary Examiner*—Sandra L. O'Shea
*Assistant Examiner*—Joseph Williams
*Attorney, Agent, or Firm*—Fish & Richardson P.C.

[57] ABSTRACT

An impregnation type cathode for a cathode ray tube includes a porous cathode piece having electron emission material impregnated therein. The porous cathode piece has a layer of W—Sc (or a layer of W—$Sc_2O_3$) on its surface and a layer of alloy formed of at least two elements of a group of elements consisting of Ir, Os, Ru, and Re on the layer of W—Sc (or the layer of W—$SC_2O_3$)

6 Claims, 2 Drawing Sheets

IMPREGNATION TYPE CATHODE FOR A CATHODIC RAY TUBE

This application is a continuation of United States application Ser. No. 08/318,376 filed Oct. 5, 1994, now abandoned.

FIELD OF THE INVENTION

This invention relates to an impregnation type cathode for a cathode ray tube, more particularly to an impregnation type cathode which is operable at a low temperature and has long life and reliability under high current density.

DESCRIPTION OF THE PRIOR ART

In general, an impregnation type cathode used in cathode ray tubes, such as CDT, CPT, large sized tube, and HDT includes a porous heat resistant metal piece(base) having the porous piece impregnated with electron emission material with barium as the main component that is diffused to the surface of the cathode through the pores of the porous piece to form a molecular layer composed of a single molecular thick barium and oxygen layer thereon at operation of the cathode to emit electrons.

As shown in FIG. 1, a conventional impregnation type cathode includes a heat resistant porous cathode piece 1 where Ba, Ca, and Al have been melted and impregnated therein under vacuum, a storage cup 2 surrounding and supporting the heat resistant porous cathode piece, a sleeve 3 having a heater 4 inserted and installed therein and supporting the storage cup from below.

Though such an impregnation type cathode has a high electron emission capability, it has problems, such as a high operating temperature of 1050–1200 deg.C, and excessive vaporization of electron emission material of barium at initial operation.

To solve these problems, elements such as Os, Ir, Ru, and Re may be deposited at 5. That is, by lowering the work function, the operating temperature can be lowered by about 100–200 deg.C. However, since the operating temperature is still high in 950–1100 deg.C, thermal distortions of electron gun parts, such as the electrode and cathode supporting eyelet is experienced. And to enable the operation at high temperature, the heat capacity of the heater should be great, but which shortens the life time of the heater. In conclusion, the high temperature gives a bad effect to the characteristics of the cathode to degrade reliability of the cathode ray tube.

SUMMARY OF THE INVENTION

The object of this invention for solving the foregoing problems is to provide an impregnation type cathode for a cathode ray tube, which is operable at low temperatures of 850–950 deg.C and has long life and reliability even under high current density.

These and other objects and features of this invention can be achieved by providing an impregnation type cathode for a cathode ray tube including a porous cathode piece having electron emission material impregnated therein, which porous cathode piece has a layer of W—Sc(or W—$Sc_2O_3$) on the surface thereof/and a layer of alloy formed of at least two element of the grap of elements consisting of Ir, Os, Ru, and Re on the layer of W—Sc(or WS—$Sc_2O_3$).

DETAILED DESCRIPTION OF THE EMBODIMENT

Figure 3:
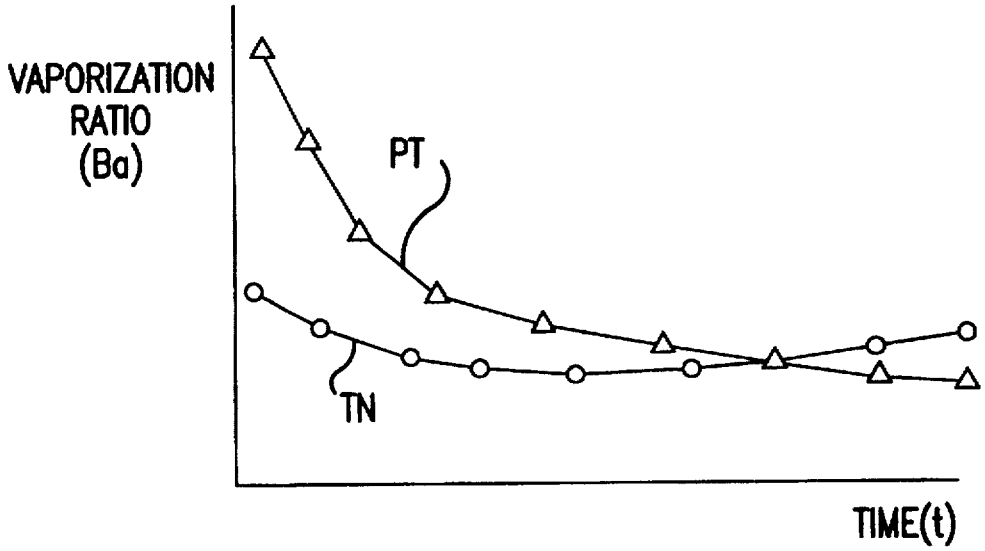
FIG. 3 is a graph showing vaporization of barium.
Figure 4:
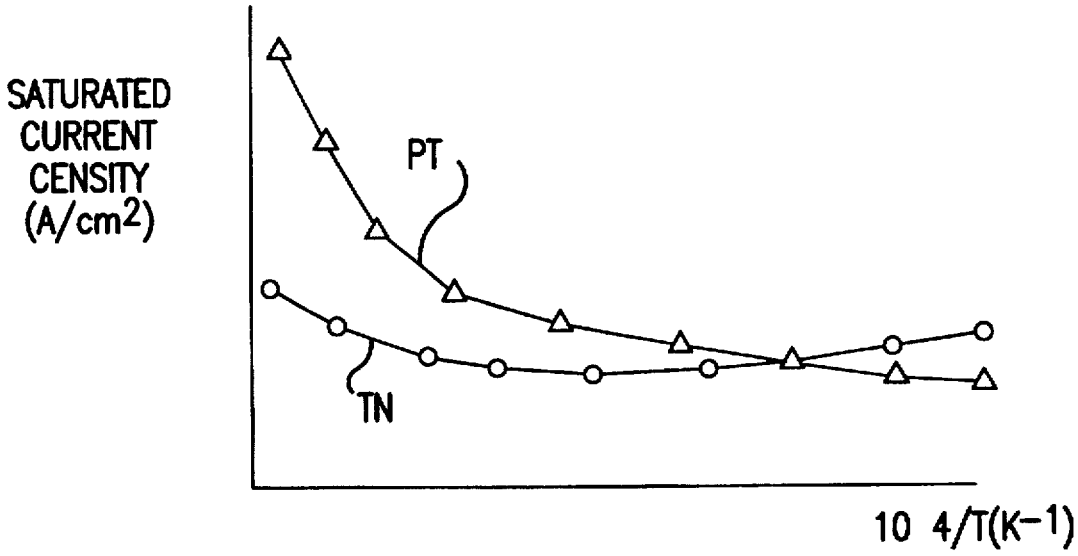
FIG. 4 is a graph showing saturated current density.

This invention is to be explained in more detail hereinafter, referring to FIGS. 2–4 attached for an embodiment of this invention. To prevent confusion of meaning in explaining the embodiments of this invention, for parts having the same system and function, the same reference numbers will be used.

Figure 1:
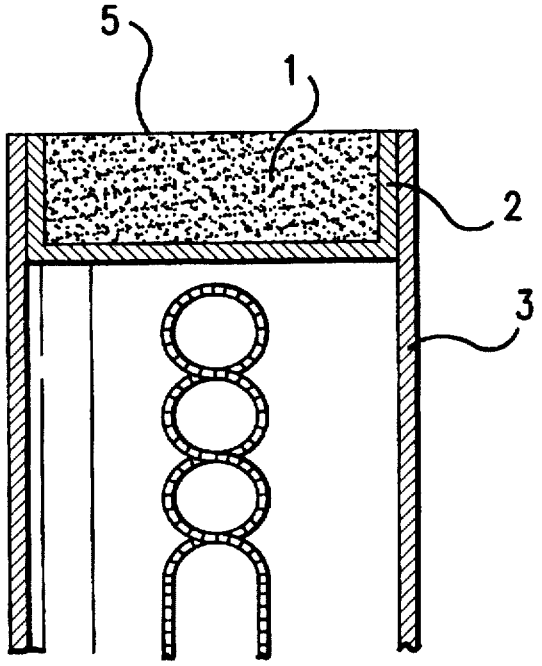
FIG.1 PRIOR ART
FIG. 1 is a conventional impregnation type cathode.
Figure 2:
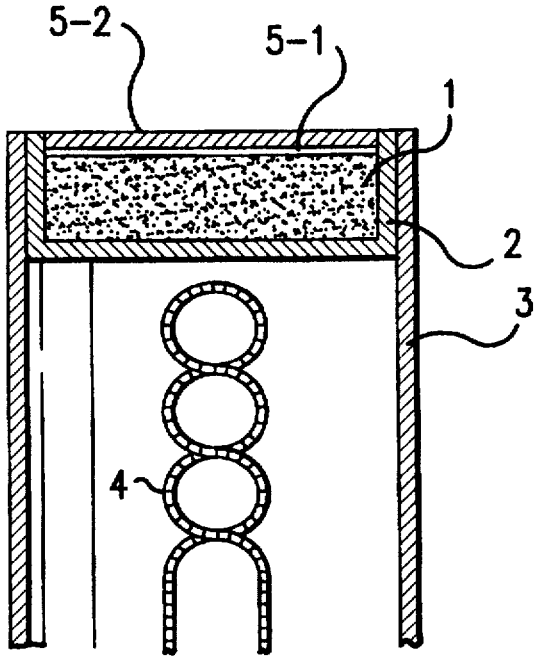
FIG. 2 is an impregnation type cathode in accordance with this invention.

Shown in FIG. 2 is an impregnation type cathode in accordance with this invention. That is, the cathode includes a porous cathode piece 1 formed at the bottom having electron emission material of BaO, CaO, and $Al_2O_3$ impregnated therein, a layer 5-1 of W—Sc(or W—$Sc_2O_3$) formed on the surface of the porous cathode piece, and a layer 5-2 of alloy formed of at least two elements of the group of elements consisting of Ir, Os, Ru, and Re on the layer 5-1.

A method for fabricating the impregnation type cathode in accordance with this invention will be explained hereinafter.

First, when a mixed powder of carbonates of $BaCO_3$ and $CaCO_3$, and $Al_2O_3$ is heated at about 1200 deg.C, the carbonates are decomposed($BaCO_3BaO+CO_2$). Such decomposed BaO and CaO, and $Al_2O_3$ are melted and impregnated into a porous cathode piece formed of high temperature heat resistant metal such as tungsten having a porosity of about 20% under vacuum at 1600–1700 deg.C. In this instant, the molecular ratio is 4:1:1 or 5:3:2.

And, after the remains of excessive electron emission material on the surface of the cathode piece is removed, a layer of W—Sc (or W—$Sc_2O_3$) is deposited on the cathode piece to a thickness of 10–20 μm with a sputtering method. In this instant, it is desirable to have the mixing ratio of W:Sc(or W:$Sc_2O_3$) to be 50–80:50–20.

Then, a layer of alloy formed of at least two elements of the group of elements consisting of Ir, Os, Ru and Re is deposited again to a thickness of deposited layer with a sputtering method.

An impregnated cathode having the W—Sc family metals (:R.,W-Sc W-$Sc_2O_3$) deposited on the surface of a cathode piece after the electron emission material has been impregnated into the cathode piece is very advantageous for low temperature operation. However, such a cathode has a problem of adverse effects caused by the reaction of Ba oxide with Sc family metals. When Ba oxide and Sc family metals react, $Ba_3Sc_4O_9$ etc. are produced on the thermal electron emission surface as by-products. This interferes with emission of thermal electrons so that the condition of emission of thermal electron becomes unstable. In this invention, a thin film layer of W—Sc is formed on the electron emission surface to obstruct heat transfer and consequently delay composition of W—Sc at the surface of the cathode piece. This increases a period of time for forming one molecular thick layer of Ba—Sc—O at the electron emission surface (the activation and aging process period of time).

Therefore, an alloy layer should be formed on the surface of W—Sc layer to a thickness of 5–20 μm.

The alloy prevent's Ba oxide from reacting with Sc family metal to compose by-products, from reading with the BaO at the surface of cathode (i.e., the BaO diffused to the surface of cathode in the activation process) to compose oxide which prevents vaporization of the Ba at the surface of cathode. This increases the density of Ba and BaO as shown in FIG. 3. At the end, as shown in FIG. 4, due to reduction of work function and shortened activation period of time, operation in high current density and a long life is possible. Herein, TN refers to this invention and PT refers to the prior art.

The reason to limit the thickness of W—Sc(or W—$Sc_2O_3$) in a range of 10–20 μm is due to the disadvantages that, in case the thickness is below 10 μm, Ba, the main component of the electron emission material, is vaporized shortening life time sharply, and in case over 20 μm, the period of time for forming the single molecular thick layer (Ba—Sc—O) on the surface of the cathode piece becomes very long consequently making Tem very long. The reason to limit the thickness of the alloy layer in a range of 5–20 μm is that, in case the thickness is below 5 μm, the cathode piece metal and the layer react to form an alloy at operation of the cathode to interfere with free Ba from diffusing to the top layer, and in the case the thickness is over 20 μm, the free Ba takes long period of time to diffuse to the top surface (Tem) and the effect of lowering work function is reduced by half. Therefore, it is desirable to have the thickness in a range of 5–20 μm.

As has been explained, through depositing W—Sc family alloy on the surface of the cathode piece having electron emission material impregnated therein, and also depositing a alloy on the surface, this invention facilitates obtaining an impregnation type cathode which is operable at a low temperature (850–950 deg.C) and has a long life under a high current density.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. An impregnation type cathode for a cathode ray tube comprising a porous cathode piece having electron emission material impregnated therein, said porous cathode piece has a layer of elemental W and elemental Sc on the surface thereof and a layer of alloy formed of at least two elements of a group of elements consisting of Ir, Os, Ru, and Re on the layer of elemental W and elemental Sc.

2. The impregnation type cathode for a cathode ray tube as claimed in claim 1, wherein a mixed ratio of elemental W to elemental Sc is 50–80;50–20.

3. The impregnation type cathode for a cathode ray tube as claimed in claim 1, wherein a thickness of the layer of elemental W and elemental Sc is 10–20 μm, and a thickness of the alloy layer is 5–20 μm.

4. An impregnation type cathode for a cathode ray tube comprising a porous cathode piece having electron emission material impregnated therein, said porous cathode piece has a layer of elemental W and $Sc_2O_3$ on the surface thereof and a layer of alloy formed of at least two elements of a group of elements consisting of Ir, Os, Ru, and Re on the layer of elemental W and $Sc_2O_3$.

5. The impregnation type cathode for a cathode ray tube as claimed in claim 4, wherein a mixed ratio of elemental W to $Sc_2O_3$ is 50–80:50–20.

6. The impregnation type cathode for a cathode ray tube as claimed in claim 4, wherein a thickness of the layer of elemental W and $Sc_3O_3$ is 1–20 μm, and a thickness of the alloy layer is 5–20 μm.

* * * * *